US011514879B2

(12) United States Patent
Honji

(10) Patent No.: US 11,514,879 B2
(45) Date of Patent: Nov. 29, 2022

(54) SOUND ABSORBING APPARATUS AND SOUND ABSORPTION STRUCTURE

(71) Applicant: Yamaha Corporation, Hamamatsu (JP)

(72) Inventor: Yoshikazu Honji, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 433 days.

(21) Appl. No.: 16/672,645

(22) Filed: Nov. 4, 2019

(65) Prior Publication Data

US 2020/0143782 A1 May 7, 2020

(30) Foreign Application Priority Data

Nov. 5, 2018 (JP) ..... JP2018-208148

(51) Int. Cl.
*G10K 11/162* (2006.01)
*G10K 11/172* (2006.01)

(52) U.S. Cl.
CPC ..... *G10K 11/162* (2013.01); *G10K 11/172* (2013.01)

(58) Field of Classification Search
CPC ..... G10K 11/162; G10K 11/172
USPC ..... 181/290, 196
See application file for complete search history.

(56) References Cited

U.S. PATENT DOCUMENTS 3,819,009 A * 6/1974 Motsinger ..... F02C 7/045 428/116
4,106,587 A * 8/1978 Nash ..... F02K 1/827 181/290
6,627,791 B1 9/2003 Veglio et al.
7,337,875 B2 * 3/2008 Proscia ..... F02C 7/24 181/290
7,413,053 B2 8/2008 Wasif et al.
7,913,813 B1 * 3/2011 Mathur ..... G10K 11/172 181/290
8,381,872 B2 2/2013 Alexander et al.
9,962,851 B2 5/2018 Slama et al.
10,755,687 B2 8/2020 Pauley
10,876,479 B2 * 12/2020 Roach ..... B32B 5/02
11,027,817 B2 * 6/2021 Porte ..... G10K 11/172
11,223,886 B1 * 1/2022 Fadul ..... H04R 1/025
(Continued)

FOREIGN PATENT DOCUMENTS

CN 109243419 A 1/2019
JP 2-71300 A 3/1990
(Continued)

OTHER PUBLICATIONS

U.S. Non-Final Office Action issued in U.S. Appl. No. 16/672,587 dated Mar. 21, 2022 (eight (8) pages).
(Continued)

*Primary Examiner* — Forrest M Phillips
(74) *Attorney, Agent, or Firm* — Crowell & Moring LLP

(57) ABSTRACT

A sound absorbing apparatus includes a first member including at least one first opening portion for enabling Helmholtz resonance, and a second member that is on the first member, has a plate shape or a sheet shape, and is formed of a porous material. The second member includes at least one second opening portion overlapping one-to-one with the at least one first opening portion in planar view. A periphery of each of the at least one second opening portion coincides with or is located outside a periphery of each corresponding one of the at least one first opening portion in planar view.

7 Claims, 12 Drawing Sheets

(56) References Cited

U.S. PATENT DOCUMENTS

| | | | | |
|---|---|---|---|---|
| 11,240,592 | B2 * | 2/2022 | Miki | H04R 1/2819 |
| 2012/0037449 | A1 | 2/2012 | Ayle | |
| 2013/0118831 | A1 * | 5/2013 | Kawai | E04B 1/8409 181/290 |
| 2019/0115005 | A1 | 4/2019 | Pauley | |
| 2019/0147843 | A1 * | 5/2019 | Fairgrieve | B32B 5/024 181/290 |

FOREIGN PATENT DOCUMENTS

| | | | |
|---|---|---|---|
| JP | 5-143081 | A | 6/1993 |
| JP | 7-90952 | A | 4/1995 |
| JP | 8-6570 | A | 1/1996 |
| JP | 2005-31240 | A | 2/2005 |
| JP | 2013-8012 | A | 1/2013 |
| JP | 2017-198723 | A | 11/2017 |
| WO | WO 2008/096630 | A1 | 8/2008 |

OTHER PUBLICATIONS

Japanese-language Office Action issued in Japanese Application No. 2018-208148 dated Jul. 26, 2022 with English translation (10 pages).

Japanese-language Office Action issued in Japanese Application No. 2018-208147 dated Aug. 2, 2022 with English translation (11 pages).

United States Final Office Action issued in U.S. Appl. No. 16/672,587 dated Jul. 14, 2022 (eight (8) pages).

* cited by examiner

SOUND ABSORBING APPARATUS AND SOUND ABSORPTION STRUCTURE

CROSS REFERENCE TO RELATED APPLICATION

This application claims priority from Japanese Patent Application No. 2018-208148, filed Nov. 5, 2018, the entire contents of which are incorporated herein by reference.

BACKGROUND OF THE INVENTION

Field of the Invention

The present disclosure relates to a sound absorbing apparatus and to a sound absorption structure.

Description of Related Art

Sound absorption structures using Helmholtz resonance are known. For example, a sound absorption structure described in Japanese Patent Application Laid-Open Publication No. 2013-008012 (hereinafter, Patent Document 1) includes a planar member having opening portions, and an air layer is provided between the planar member and a wall body. The sound absorption structure described in Patent Document 1 further includes extension members that are connected to the respective opening portions of the planar member. At least a part of each of the extension members is housed in the air layer and is separated from the wall body. A plasterboard is used for the planar member in Patent Document 1.

However, because the sound absorption structure described in Patent Document 1 absorbs sound using only Helmholtz resonance, there is a drawback in that the sound frequency band (range) that can be absorbed is narrow.

SUMMARY

In view of the circumstances described above, the present disclosure has an object of broadening the sound-absorption frequency band.

In order to solve the above problem, a sound absorbing apparatus according to a preferred aspect of the present disclosure includes a first member including at least one first opening portion for enabling Helmholtz resonance, and a second member that is disposed on the first member, has a plate shape or a sheet shape, and is formed of a porous material, in which, the second member includes at least one second opening portion overlapping one-to-one with the at least one first opening portion in planar view, and in which a periphery of each of the at least one second opening portion coincides with or is located outside a periphery of each corresponding one of the at least one first opening portion in planar view.

A sound absorption structure according to a preferred aspect of the present disclosure includes the sound absorbing apparatus and a wall body on which the sound-absorbing unit is installed.

DESCRIPTION OF EMBODIMENT

1. Embodiment

Figure 1:
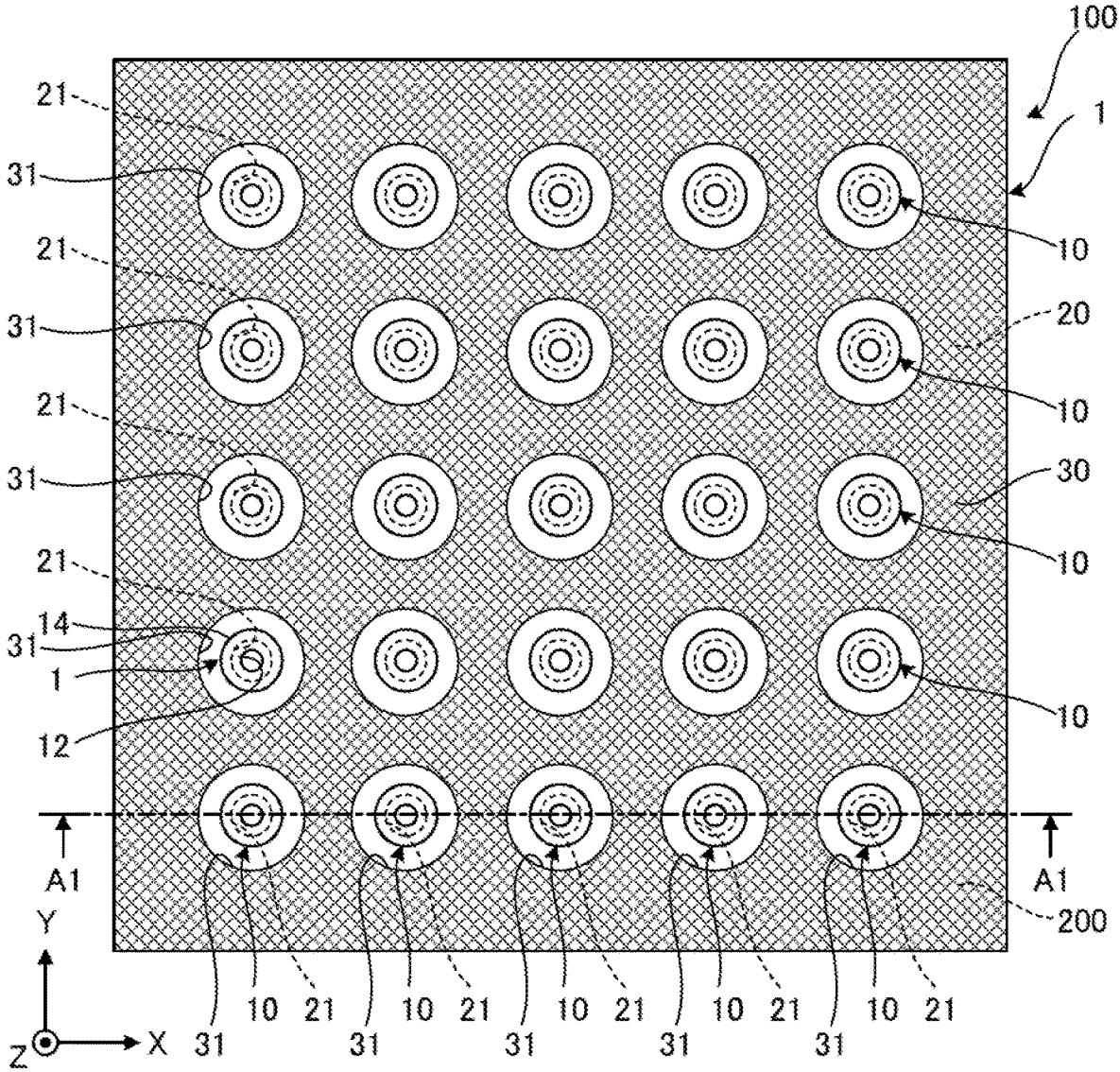
FIG. 1 is a plan view of a sound absorption structure according to an embodiment.

An embodiment of the present disclosure is explained below with reference to the drawings. It is of note that the dimensions and scales of parts in the drawings may be different from actual products, as appropriate. The embodiment described below is a preferred specific example of the present disclosure. Therefore, various technically preferable limitations are added to the embodiment. However, the scope of the present disclosure is not limited to the embodiment unless there are descriptions particularly limiting the present disclosure in the following explanations.

1-1. Configuration of Sound Absorption Structure

Figure 2:
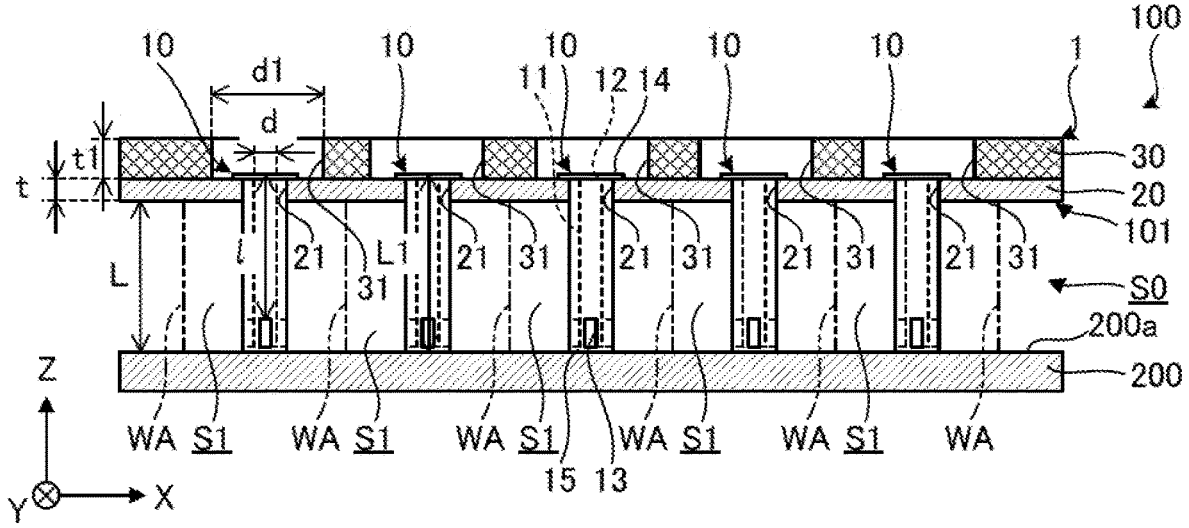
FIG. 2 is a cross-sectional view taken along a line A1-A1 in FIG. 1.

FIG. 1 is a plan view of a sound absorption structure 100 according to an embodiment. FIG. 2 is a cross-sectional view taken along a line A1-A1 in FIG. 1. The sound absorption structure 100 shown in FIGS. 1 and 2 is a structure that absorbs sound using Helmholtz resonance. The sound absorption structure 100 includes a wall body 200 and a sound absorbing apparatus 1 installed on the wall body 200. The sound absorbing apparatus 1 includes a planar or sheet-like base material 20, tubular sound absorbing members 10 penetrating through the base material 20, and a porous material 30 arranged on the base material 20. A structure 101 constituted by the sound absorbing members 10 and the base material 20 is an example of a first member. The porous material 30 is an example of a second member.

The base material 20 is supported on the wall body 200 via the sound absorbing members 10. A space S0 is formed between the wall body 200 and the base material 20. The space S0 communicates with an external space through the insides of the sound absorbing members 10. Within the space S0, there are formed multiple spaces S1 that are compartmentalized by the sound absorbing members 10. The space S0 serves as a container of a typical Helmholtz resonator for each space S1 corresponding to each sound absorbing member 10. The porous material 30 can absorb sound in a frequency band different from that of sound absorption by Helmholtz resonance. Parts of the sound absorption structure 100 are explained below in sequence.

As shown in FIGS. 1 and 2, a certain direction (a left or right direction in FIG. 1) along a wall surface 200*a* of the wall body 200 is referred to as an "X direction", a direction (an upper or lower direction in FIG. 1) orthogonal to the X direction along the wall surface 200*a* is referred to as a "Y direction", and a direction normal to the wall surface 200*a* is referred to as a "Z direction" in the following explanations. The right side in FIG. 1 is a positive side of the X direction and the left side is a negative side of the X direction. The upper side in FIG. 1 is a positive side of the Y direction and the lower side is a negative side of the Y direction. The near side of the drawing of FIG. 1 is a positive side of the Z direction and the far side is a negative side of the Z direction. A state as viewed from the Z direction is referred to as a "planar view" in the following explanations.

The wall body 200 is a structure that supports the sound absorbing apparatus 1. For example, the wall body 200 is a casing of an acoustic device such as a speaker system, a panel used as a door or the like of a movable body such as a vehicle, an inner wall of a building, or a structure fixed to any of these parts. It will be explained later with respect to an application example of a case in which the sound absorption structure 100 is installed on a speaker system or a vehicle door.

The base material 20 is a member that has a plate shape or a sheet shape including holes 21. It is preferable that the base material 20 be pliable, in other words, be flexible. Because of the pliability of the base material 20, the base material 20 can be deformed along the wall surface 200*a* and can be arranged thereon even when the wall surface 200*a* of the wall body 200 is curved. Examples of the constituent material of the base material 20 include an elastomer material, a resin material, and a metallic material, although this is not particularly so limited. The base material 20 may be formed of a dense body or a porous body as long as the sound absorption structure 100 can produce Helmholtz resonance. A thickness t of the base material 20 is determined according to the strength, ease in handling, and the like, required for the base material 20. The thickness t is preferably, for example, not less than 1 millimeter and not greater than 10 millimeters so that the base material 20 is pliable, although this is not particularly so limited. It is of note that the shape or size of the base material 20 in planar view is not limited to that in the example shown in FIG. 1 and may be appropriately set according to installation location, sound absorbing characteristics, and the like of the sound absorption structure 100.

The holes 21 are holes into which the sound absorbing members 10 are respectively inserted. In the example shown in FIG. 1, the holes 21 are arranged regularly in a matrix in planar view. The shape in planar view of each of the holes 21 shown in FIG. 1 is a circle. It is of note that the number of holes 21, the number of rows, the number of columns, the pitch of the rows, and the pitch of the columns are determined according to the size, the sound absorbing characteristics, and the like of the sound absorption structure 100 and are not limited to those in the example shown in FIG. 1. The arrangement of the holes 21 is not limited to that in the example shown in FIG. 1 and may be, for example, other regular arrangements such as a zigzag arrangement. The shape in planar view of the holes 21 is determined according to the outer shape and the like of the sound absorbing members 10 and may be, for example, a polygon such as a rectangle, a pentagon, or a hexagon, and is not limited to a circle.

The sound absorbing members 10 are tubular members inserted into the holes 21 of the base material 20 described above and enabling the space S0 and the external space to be communicated with each other. The constituent material of the sound absorbing members 10 is freely selectable. Examples of the constituent material include a resin material, a carbon material, a metallic material, a ceramics material, or a composite material including two or more thereof. Among these materials, a resin material is preferable because of being more easily moldable, being lighter in weight, and being lower in cost than other materials.

Figure 3:
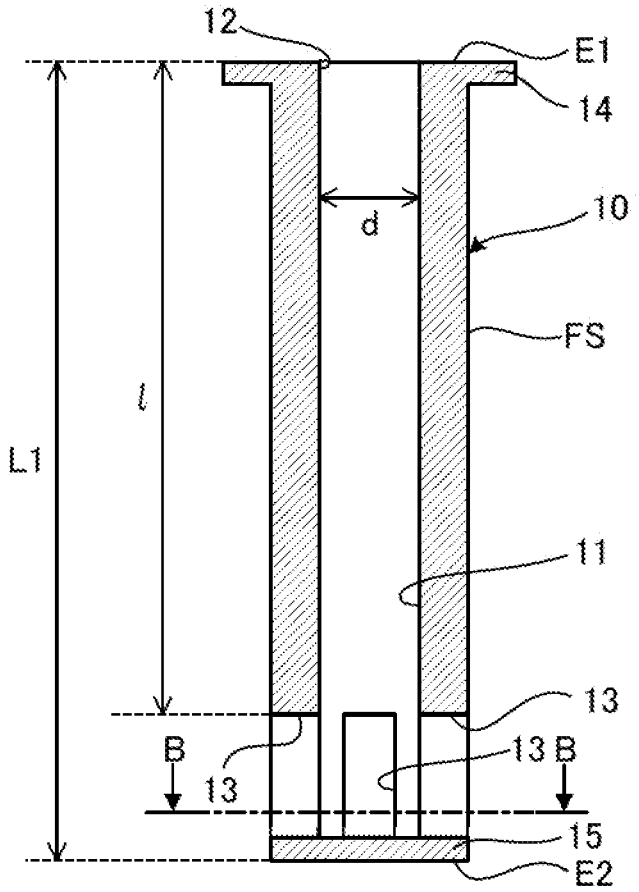
FIG. 3 is a vertical cross-sectional view of a first member in the embodiment.
Figure 4:
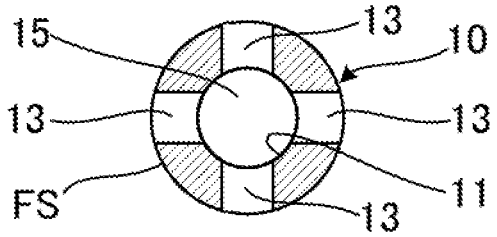
FIG. 4 is a cross-sectional view taken along a line B-B in FIG. 3.

FIG. 3 is a vertical cross-sectional view of the sound absorbing members 10 in the first embodiment. FIG. 4 is a cross-sectional view taken along a line B-B in FIG. 3. As shown in FIG. 3, each of the sound absorbing members 10 has a tubular shape including a hollow portion 11. The sound absorbing members 10 each include a first end face E1, a second end face E2 being the opposite end face to the first end face E1, and a side face FS located between the first end face E1 and the second end face E2.

An opening portion 12 communicated with the hollow portion 11 is provided on the first end face E1 of the sound absorbing member 10. The opening portion 12 is an example of a first opening portion. Opening portions 13 communicated with the hollow portion 11 are provided on the side face FS of the sound absorbing member 10 at a position nearer the second end face E2 than the first end face E1. Therefore, each of the opening portions 13 is communicated with the opening portion 12 via the hollow portion 11. Accordingly, each of the sound absorbing members 10 functions as a tube of a typical Helmholtz resonator.

Since the opening portions 13 are provided on the side face FS, the opening portions 13 are not closed by the wall body 200 and the function is maintained even when the second end face E2 is brought into contact with the wall body 200. With a viewpoint of preferably exhibiting this function, the total opening area of the opening portions 13 is preferably equal to or larger than the opening area of the opening portion 12. As shown in FIG. 4, the opening portions 13 are arranged in a circumferential direction of the side face FS. This arrangement has an advantage that the mechanical strength of the sound absorbing members 10 is likely to be higher even when the necessary opening area of the opening portions 13 is provided than a case of including one opening portion 13. Since the opening portions 13 are arranged at the position nearer the second end face E2 than the first end face E1, a length l of a portion corresponding to the tube of a typical Helmholtz resonator in each of the sound absorbing members 10 can be formed longer than that in other cases. This enables the frequency band in which the sound absorption structure 100 can absorb sound to be lowered while a length L1 of the sound absorbing members 10 can be shortened to make the sound absorption structure 100 thinner. It is of note that, although the number of the opening portions 13 is four in the example shown in FIG. 4, the number thereof is not limited thereto, and it may be three or fewer or five or more, for example.

A flange portion 14 protruding from the side face FS is formed on each of the sound absorbing members 10 along an outer periphery of the first end face E1. The flange portion 14 is brought into contact with one face (a face on the upper side in FIG. 2) of the base material 20 to restrict the position with respect to the base material 20. That is, the sound absorbing members 10 are positioned with respect to the base material 20 using the respective flange portions 14. This configuration can reduce fluctuation of the sound-absorbable frequency band of the sound absorption structure 100 caused by misalignment of the sound absorbing members 10 with respect to the base material 20. A face of the flange portion 14 on the side of the base material 20 can be used as a joining face for joining with the base material 20. Therefore, the flange portion 14 is fixed to the base material 20 with an adhesive or a pressure-sensitive adhesive as required. The outer shape of the flange portion 14 in planar view in the present embodiment is a circle. The amount of outward protrusion of the flange portion 14 is, for example, in a range not less than 0.1 millimeter and not greater than 5 millimeters, although this is not particularly limited thereto. The thickness of the flange portion 14 is in a range not less than 0.1 millimeter and not greater than 5 millimeters although not particularly limited thereto. The outer shape of the flange portion 14 in planar view is not limited to a circle and may be, for example, a polygon such as a rectangle, a pentagon, or a hexagon. The flange portion 14 may be omitted.

The second end face E2 of each of the sound absorbing members 10 according to the present embodiment is a bottom portion 15 that closes an end of the sound absorbing member 10. That is, the sound absorbing members 10 have a bottomed tube shape that is open at one end. The second end face E2 is fixed to the wall body 200. The sound absorbing members 10 function as spacers that define a distance L between the base material 20 and the wall body 200. This function allows for making the distance L between the base material 20 and the wall body 200 uniform even when the wall surface 200*a* of the wall body 200 is curved. Consequently a desired sound absorption effect of the sound absorption structure 100 is obtained.

The method of fixing the bottom portions 15 or the sound absorbing members 10 to the wall body 200 is freely selectable. Examples of the method include a fixing method using an adhesive, a pressure-sensitive adhesive, and a fixing method by respectively fitting concave portions formed on the wall surface 200*a* and the bottom portions 15 to each other. It is of note that the bottom portions 15 may be omitted. In this case, the sound absorbing members 10 may be fixed to the wall body 200 by respectively fitting opening portions provided on the second end faces E2 and convex portions provided on the wall surface 200*a* to each other.

The porous material 30 is arranged on a face opposite to the wall body 200 of the base material 20, that is, on a face on the side of the first end face E1 of the base material 20 described above. The porous material 30 is a planar or sheet-like porous body. The porous body has holes 31 overlapping with the respective holes 21 of the base material 20 in planar view. The holes 31 are an example of a second opening portion. The shape of each of the holes 31 in planar view is a circle in the example shown in FIG. 1. However, the shape thereof is not limited thereto and may be, for example, a polygon such as a rectangle, a pentagon, or a hexagon or may be different from the shape of the opening portions 12 in planar view of the sound absorbing members 10. It is preferable that the porous material 30 be pliable, in other words, be flexible. The pliability of the porous material 30 enables the porous material 30 to be arranged along the wall surface 200*a* even when the wall surface 200*a* of the wall body 200 is curved. The porous material 30 is formed of a porous body such as glass fiber, felt, or urethane foam. The porous material 30 constituted by the porous body allows sound to be absorbed in a frequency band higher than the frequency band in which sound can be absorbed by Helmholtz resonance. Therefore, it is possible to widen the frequency band in which the sound absorption structure 100 can absorb sound as compared to a case of not using the porous material 30.

The holes 31 are arranged one-to-one to the holes 21 of the base material 20 and overlap one-to-one with the holes 21 in planar view. In the example shown in FIG. 1, the holes 31 are arranged regularly in a matrix in planar view to correspond to the holes 21, respectively. A periphery of each of the holes 31 is located outside a periphery of a corresponding one of the opening portions 12 of the sound absorbing members 10 described above in planar view. Accordingly, it is possible to suppress the porous material 30 from hindering sound absorption of the sound absorption structure 100 by Helmholtz resonance. The relationship between the opening portions 12 and the holes 31 will be explained in detail later.

1-2. Operation of Sound Absorption Structure

Figure 5:
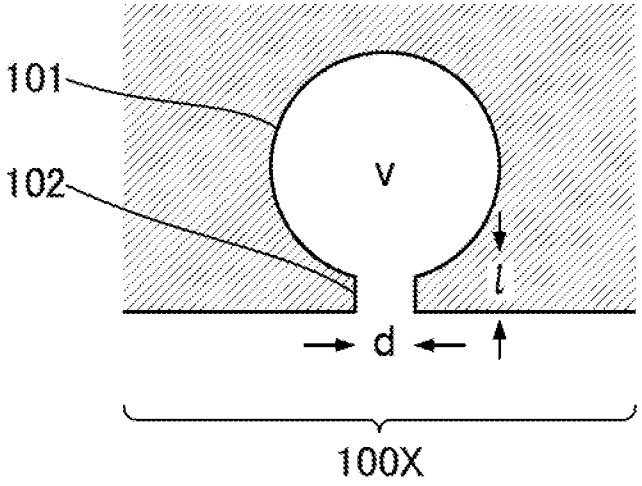
FIG. 5 is a diagram schematically showing a typical Helmholtz resonator.

FIG. 5 is a diagram schematically showing a typical Helmholtz resonator 100X. The Helmholtz resonator 100X includes a container 101 and a tube 102 connected to the container 101. In the Helmholtz resonator 100X, air in the container 101 and air in the tube 102 constitute an oscillating system using the air in the tube 102 as the mass and the air in container 101 as a spring. When this oscillating system resonates, the air in the tube 102 oscillates hard, and thus, a sound absorption operation is generated due to frictional loss of the air in the tube 102. When the volume in the container 101 is V, the length of the tube 102 is 1, and the transverse sectional area in the tube 102 is s, a resonant frequency $f_o$ of the Helmholtz resonator 100X is represented by the following Equation 1

$$f_0 = \frac{c}{2\pi}\sqrt{\frac{s}{V(l+\delta)}}. \tag{1}$$

In this Equation (1), c denotes a sound speed in the air. Further, δ denotes an opening-end correction value. When the transverse sectional shape in the tub 102 is a circle, δ is represented as δ≈0.8×d where the diameter in the tube 102 is d.

In addition, in the sound absorption structure 100 configured as described above, the space S0 is divided due to the balance of pressures from the sound absorbing members 10 and these divided portions function as walls WA. Therefore, the space S0 is partitioned by the walls WA into spaces S1 for the sound absorbing members 10. Each of the spaces S1 corresponds to a space in the container 101 described above. A portion between the opening portion 12 of the hollow portion 11 and the opening portion 13 corresponds to the tube 102 described above. Therefore, the length of this portion corresponds to the length l described above. When the aperture ratio of the opening portions 12 on the base material 20 is P, and the distance between the base material 20 and the wall body 200 is L, P/L has a relationship approximated by s/V described above. Therefore, from this relationship and the Equation (1) described above, the resonant frequency $f_o$ of the sound absorption structure 100 is represented by the following Equation (2).

$$f_0 = \frac{c}{2\pi}\sqrt{\frac{P}{L(l+\delta)}} \tag{2}$$

As will be understood from the Equation (2), the resonant frequency $f_o$ is adjustable according to the aperture ratio P, the distance L, and the length l. Where the resonant frequency $f_o$ indicates a frequency at which the sound absorption structure 100 can most efficiently absorb sound. The resonant frequency $f_o$ is lowered by increasing the distance L or the length l.

Substantial portions of the sound absorbing members 10 are arranged in the space S0 in the sound absorption structure 100 according to the present embodiment. Therefore, even when the distance L or the length l is increased, the thickness of the sound absorption structure 100 is reduced as compared to a case of using the holes 21 as the tubes 102 without using the sound absorbing members 10. Accordingly, in the sound absorption structure 100, the sound absorbable frequency is lowered while thinning is achieved. It is of note that the resonant frequency $f_o$ is also lowered by decreasing the aperture ratio P. In this case, however, the number of Helmholtz resonators included in the sound absorption structure 100 per unit area decreases, and as a result, the sound absorption effect is reduced.

In order to support the base material 20 with respect to the wall body 200, the sound absorbing members 10 function as spacers that define the distance between the wall body 200 and the base material 20. This function as spacers enables variation of the distance L described above depending on the position of the sound absorption structure 100 in a plane direction to be reduced. As a result, the sound absorption structure 100 can exhibit a desired sound absorption effect.

1-3. Relationship Between Opening Portions 12 and Holes 31

The sound absorption effect generated by a Helmholtz resonator is higher as the resonance in the Helmholtz resonator is stronger. Elements having effects on the strength of the resonance include, for example, constituent materials of the Helmholtz resonator, surface roughness, stiffness, airtightness, and acoustic resistance of an opening portion. It can be said that the acoustic resistance of the opening portion among these elements is most likely to affect the strength of the resonance in a Helmholtz resonator that is designed and manufactured appropriately.

Figure 6:
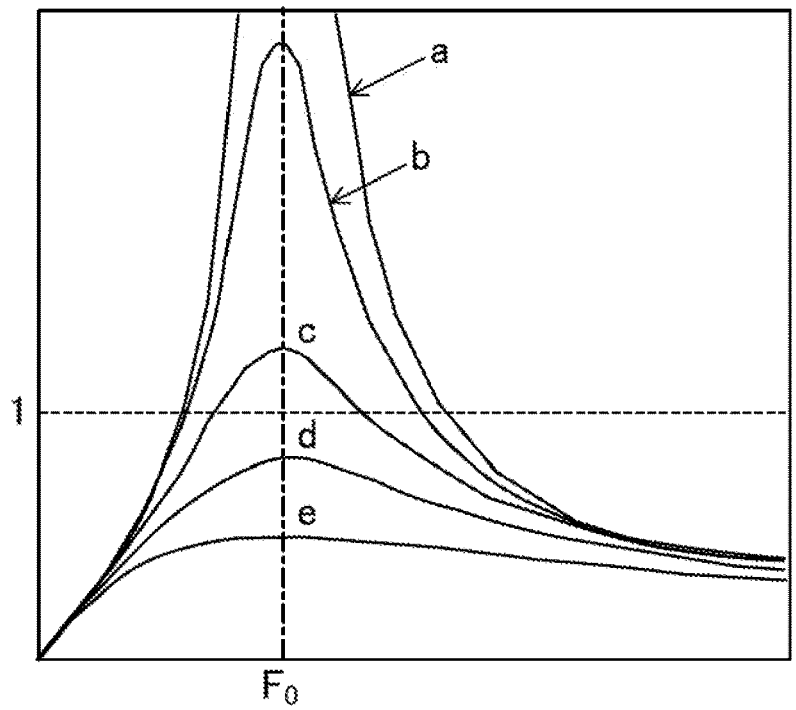
FIG. 6 is a graph showing a relationship between frequency and gain in a resonant system for each size of a resistive element.

FIG. 6 is a graph showing a relationship between frequency and gain in a resonant system for each size of a resistive element. In FIG. 6, the horizontal axis represents a standardized frequency and the vertical axis represents a gain. The resistive element corresponds to the acoustic resistance of the opening portion in a Helmholtz resonator. The gain corresponds to the sound absorbing ratio of the Helmholtz resonator. In FIG. 6, "a" indicates a case in which the resistive element is smallest and "e" indicates a case in which the resistive element is largest. In FIG. 6, the resistive element increases in size in the order of a, b, c, d, and e. As is apparent from FIG. 6, when the resistive element increases in size, the gain in the resonant frequency $f_o$ decreases. Therefore, when the acoustic resistance increases, the sound absorbing ratio of the Helmholtz resonator decreases.

More specifically, when the opening portion of a Helmholtz resonator is covered by a porous material having a sufficient sound absorption effect in mid-tone and high-tone ranges from 500 Hz to 4 kHz, the acoustic resistance at the opening portion is larger, and thus, the sound absorbing ratio obtained by Helmholtz resonance significantly decreases. Therefore, in the sound absorption structure 100 described above, the porous material 30 is arranged so as not to close the opening portions 12. However, it is preferable that the acoustic resistance at the opening portions 12 have an appropriate magnitude to maximize the sound absorbing ratio obtained by Helmholtz resonance. The appropriate magnitude of the acoustic resistance is realized by covering the opening portions 12 with a small acoustic resistive element (e.g., mesh cloth) that does not itself have a substantial sound absorption effect.

Figure 7:
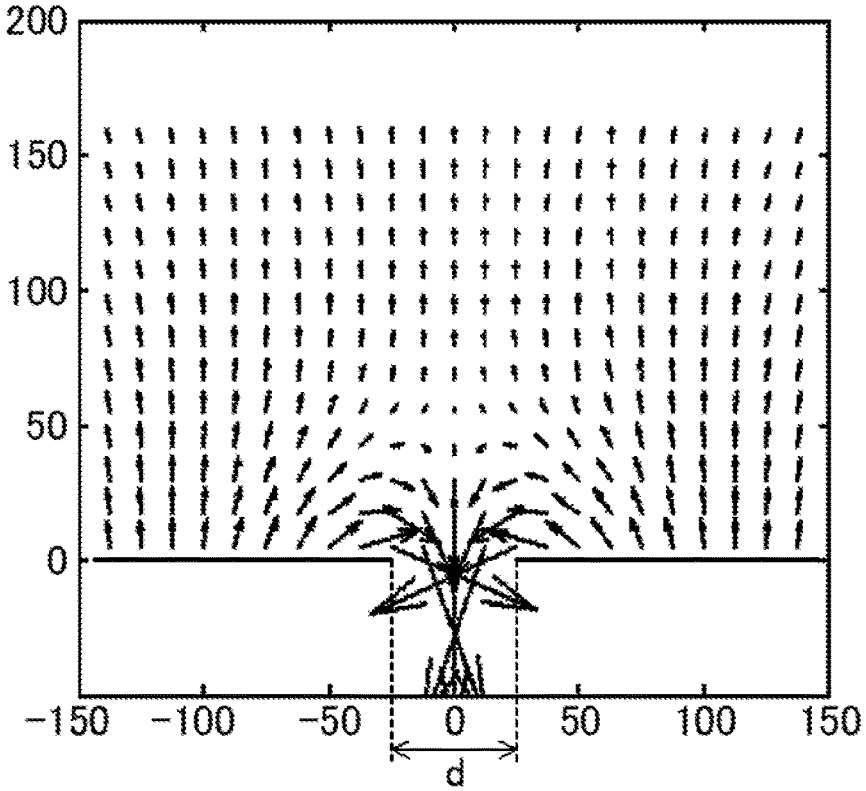
FIG. 7 is a diagram showing a relationship between an opening portion of a Helmholtz resonator and a flow of sound.

FIG. 7 is a diagram showing a relation between an opening portion of a Helmholtz resonator and a flow of sound. FIG. 7 shows a simulation result of a distribution of sound intensities of acoustic echo. This simulation is an example of a case in which sound is vertically incident on a planar wall surface that is a rigid wall corresponding to an infinite acoustic resistance and that has an opening portion of a Helmholtz resonator on a part. The horizontal axis in FIG. 7 represents a distance [millimeters] from the center of the opening portion and the vertical axis represents a distance [millimeters] from the wall surface. In the present simulation, the acoustic resistance at the opening portion of the Helmholtz resonator is adjusted to maximize the sound absorbing ratio obtained by Helmholtz resonance. While a width d of the opening portion is 50 millimeters in the present simulation, a result having the same tendency is obtained even when the width d is changed.

As shown in FIG. 7, a phenomenon occurs in a Helmholtz resonator, in which acoustic echo at a part around the opening portion is absorbed into the Helmholtz resonator. This phenomenon occurs when there is a sufficient difference in acoustic impedance between the opening portion of the Helmholtz resonator and the wall surface therearound. In this case, the sound absorption effect of the Helmholtz resonator is obtained not only by sound directly incident on the opening portion but also by taking in sound incident on the wall surface around the opening portion to be incident on the opening portion.

The acoustic impedance (absolute value) at the resonant frequency $f_o$ of the Helmholtz resonator is smallest at the opening portion. The acoustic reactance, which is an imaginary part of the acoustic impedance of a complex number, is zero. The acoustic resistance, which is a real part thereof, has a value corresponding to the element of the acoustic resistance at the opening portion of the Helmholtz resonator.

Meanwhile, when an ideal rigid wall is installed around the opening portion of a Helmholtz resonator, the acoustic impedance (the real part) is infinite. In contrast thereto, when a porous material is arranged around the opening portion of a Helmholtz resonator, the acoustic impedance decreases. Therefore, it is preferable that a part around the opening portion of the Helmholtz resonator be a wall surface as close to a rigid wall as possible to increase the sound absorption effect of the Helmholtz resonator.

In this connection, in the sound absorbing apparatus 1 according to the present embodiment, as described above, the periphery of each of the holes 31 (an example of the second opening portion) is located outside the periphery of the corresponding one of the opening portions 12 (an example of the first opening portion) in planar view. This configuration can suppress the porous material 30 from hindering sound absorption due to Helmholtz resonance. It is of note that the periphery of each of the holes 31 may match with the periphery of the corresponding one of the opening portions 12 in planar view. Also in this case, the sound absorption effect due to Helmholtz resonance is higher as compared to a case in which the opening portions 12 are covered by a porous material.

In order to realize the positional relationship between the periphery of each of the opening portions 12 and the periphery of each of the holes 31 described above, when the width of each of the holes 31 on the porous material 30 is d1 and the width of each of the opening portions 12 is d, and a ratio d1/d between widths d and d1 is equal to or greater than 1.0. The width d of each of the opening portions 12 is the length of the opening portion 12 in a direction perpendicular to the central axis of the opening portion 12 as viewed in a cross section including the central axis. The width d1 of each of the holes 31 is the length of the hole 31 in a direction perpendicular to the central axis of the opening portion 12 corresponding to the hole 31 as viewed in a cross section including the central axis. The ratio d1/d is a ratio between the widths d and d1 as viewed in the same cross section.

From the results shown in FIG. 7, the ratio d1/d between the widths d and d1 is preferably not less than 1.0 and not greater than 6.0. It is more preferable when the ratio d1/d is set to be not less than 2.0 and not greater than 6.0, when the ratio d1/d is set to be not less than 3.2 and not greater than 6.0, and when the ratio d1/d is set to be not less than 4.0 and not greater than 6.0, in this order. Having the ratio d1/d in this range makes it possible to preferably obtain both of the sound absorption effect due to Helmholtz resonance and the sound absorption effect due to the porous material 30. In contrast to this, if the ratio d1/d is too small, the sound absorption effect due to Helmholtz resonance has a tendency to rapidly decrease. Conversely, if the ratio d1/d is too great, the sound absorption effect due to the porous material 30 is remarkably decreased. No further improvement in the sound absorption effect due to Helmholtz resonance is observed even if the ratio d1/d is made very great.

The aperture ratio of the holes 31 on the porous material 30 is preferably equal to or less than 50% and is more preferably not less than 1% and not greater than 50%. When the aperture ratio is within this range, it is possible to produce an identical degree of sound absorption effect due to the porous material 30 as that in a case of not including the holes 31. In contrast thereto, the sound absorption effect due to the porous material 30 has a tendency to rapidly decrease if the aperture ratio is too high. Conversely, if the aperture ratio is too low, it is difficult to cause the opening area of the holes 31 to be larger than that of the holes 21, depending on the aperture ratio of the holes 21.

2. Application Example

An application example of the sound absorption structure 100 described above will be explained below.

2-1. Speaker System

Figure 8:
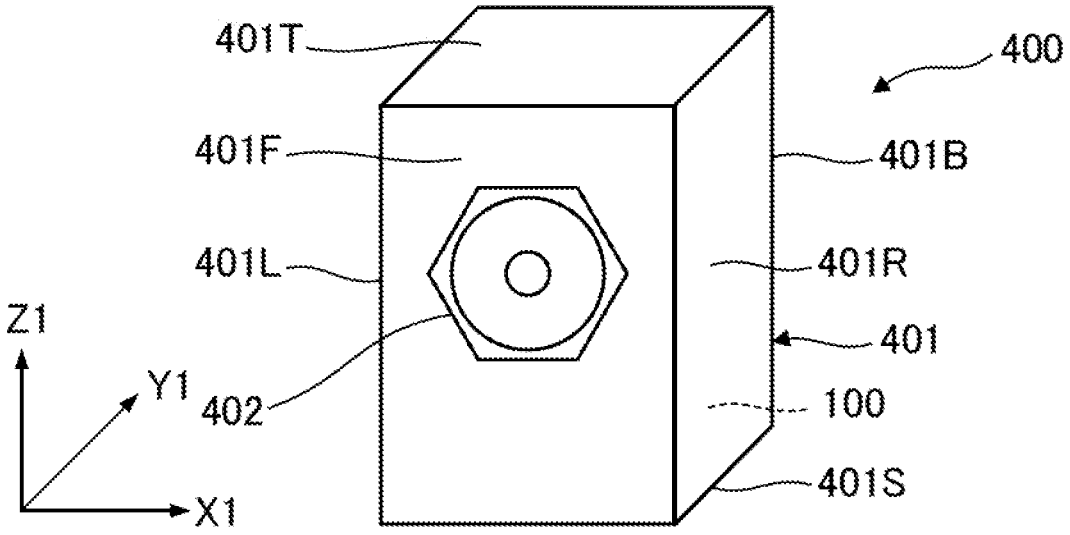
FIG. 8 is a perspective view schematically showing an application example in a case in which the sound absorption structure is installed in a speaker system.

FIG. 8 is a perspective view schematically showing an application example in a case in which the sound absorption structure 100 is installed on a speaker system 400. The speaker system 400 has a casing 401, and a speaker unit 402 and the sound absorption structure 100 attached to the casing 401. The casing 401 is a hollow cuboid having an opening portion to which the speaker unit 402 is attached. That is, the casing 401 has a right wall 401R, a left wall 401L, a front wall 401F, a back wall 401B, a top wall 401T, and a bottom wall 401S. The right wall 401R and the left wall 401L face each other in an X1 direction. The front wall 401F and the back wall 401B face each other in a Y1 direction. The top wall 401T and the bottom wall 401S face each other in a Z1 direction. It is of note that the X1 direction, the Y1 direction, and the Z1 direction shown in FIG. 8 are orthogonal to each other.

Figure 9:
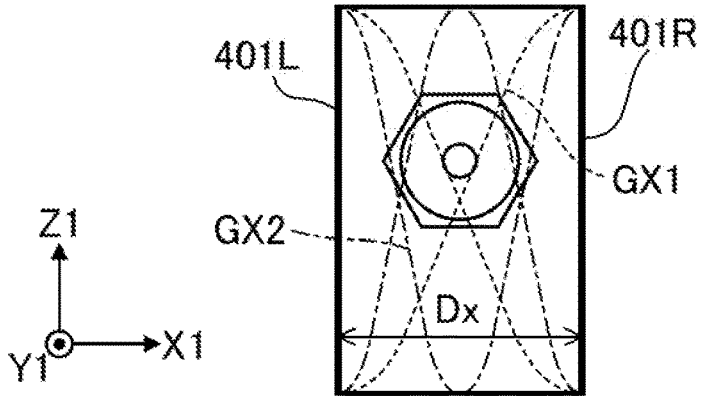
FIG. 9 is a diagram schematically showing a state of standing waves generated between a right wall and a left wall of a casing of the speaker system.
Figure 10:
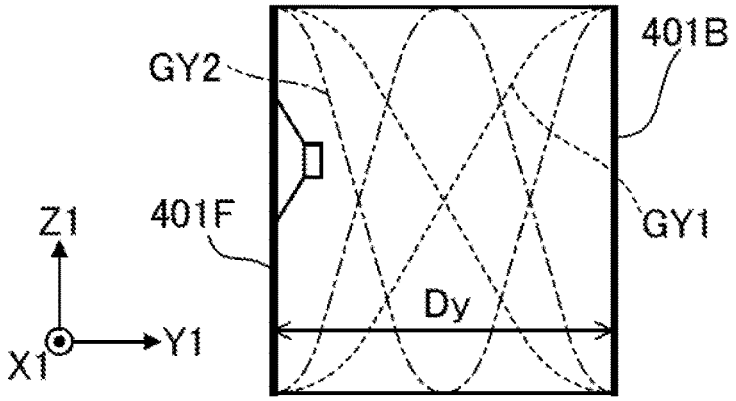
FIG. 10 is a diagram schematically showing a state of standing waves generated between a front wall and a back wall of the casing of the speaker system.
Figure 11:
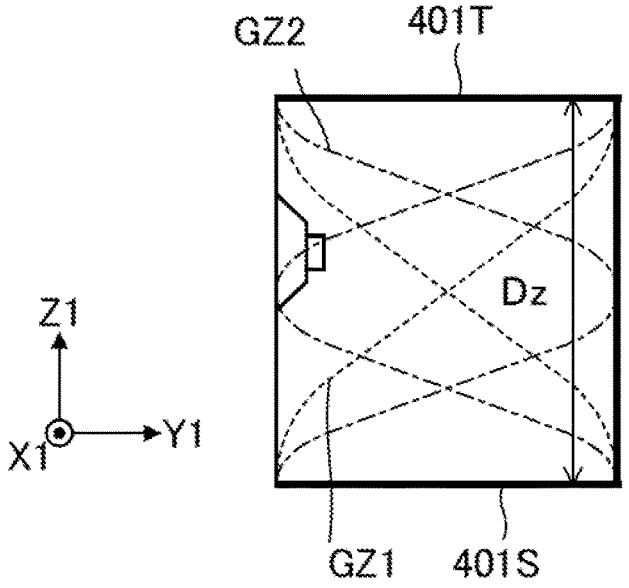
FIG. 11 is a diagram schematically showing a state of standing waves generated between a top wall and a bottom wall of the casing of the speaker system.

FIG. 9 is a diagram schematically showing a state of standing waves GX1 and GX2 generated between the right wall 401R and the left wall 401L. FIG. 10 is a diagram schematically showing a state of standing waves GY1 and GY2 generated between the front wall 401F and the back wall 401B. FIG. 11 is a diagram schematically showing a state of standing waves GZ1 and GZ2 generated between the top wall 401T and the bottom wall 401S. The standing waves GX1, GY1, GZ1, GX2, GY2, and GZ2, each shown in FIGS. 9 to 11, are standing waves in one dimension (axial waves), respectively. The standing wave GX1 is a first-order standing wave in the X1 direction. The standing wave GY1 is a first-order standing wave in the Y1 direction. The standing wave GZ1 is a first-order standing wave in the Z1 direction. The standing wave GX2 is a second-order standing wave in the X1 direction. The standing wave GY2 is a second-order standing wave in the Y1 direction. The standing wave GZ2 is a second-order standing wave in the Z1 direction. The standing waves GX1, GY1, and GZ1 each is indicated by broken lines, and the standing waves GX2, GY2, and GZ2 each is indicated by dashed-dotted lines in FIGS. 9 to 11.

The sound absorption structure 100 is installed on a part of or the entire region of the inner surface of one or more of the six walls of the casing 401 described above. For example, when the sound absorption structure 100 is installed on one or both of inner surfaces of the right wall 401R and the left wall 401L, the standing wave GX1 or GX2 described above is reduced by setting the frequency band in which the sound absorption structure 100 can absorb sound according to the frequency of the standing wave GX1 or GX2. Similarly, when the sound absorption structure 100 is installed on one or both of inner surfaces of the front wall 401F and the back wall 401B, the standing wave GY1 or GY2 described above is reduced by setting the frequency band in which the sound absorption structure 100 can absorb sound according to the frequency of the standing wave GY1 or GY2. When the sound absorption structure 100 is installed on one or both of inner surfaces of the top wall 401T and the bottom wall 401S, the standing wave GZ1 or GZ2 described above is reduced by setting the frequency band in which the sound absorption structure 100 can absorb sound according to the frequency of the standing wave GZ1 or GZ2. As described above, the sound quality of the speaker system 400 is improved by reducing one or more of the standing waves GX1, GY1, GZ1, GX2, GY2, and GZ2.

Alternatively, the frequency band in which the sound absorption structure 100 can absorb sound may be set according to frequencies of standing waves in two dimensions (tangential waves) or standing waves in three dimensions (oblique waves). This allows for reduction of the standing waves in two dimensions or three dimensions in the casing 401. The frequency band in which the sound absorption structure 100 can absorb sound may be alternatively set according to frequencies of three or higher-order standing waves. This allows for reduction of three or higher-order standing waves in the casing 401. Although a case in which the sound absorption structure 100 is installed on the speaker system 400 is shown in FIG. 11, a sound absorption structure 100A or 100B described later may be used instead of the sound absorption structure 100.

2-2. Vehicle Door

Figure 12:
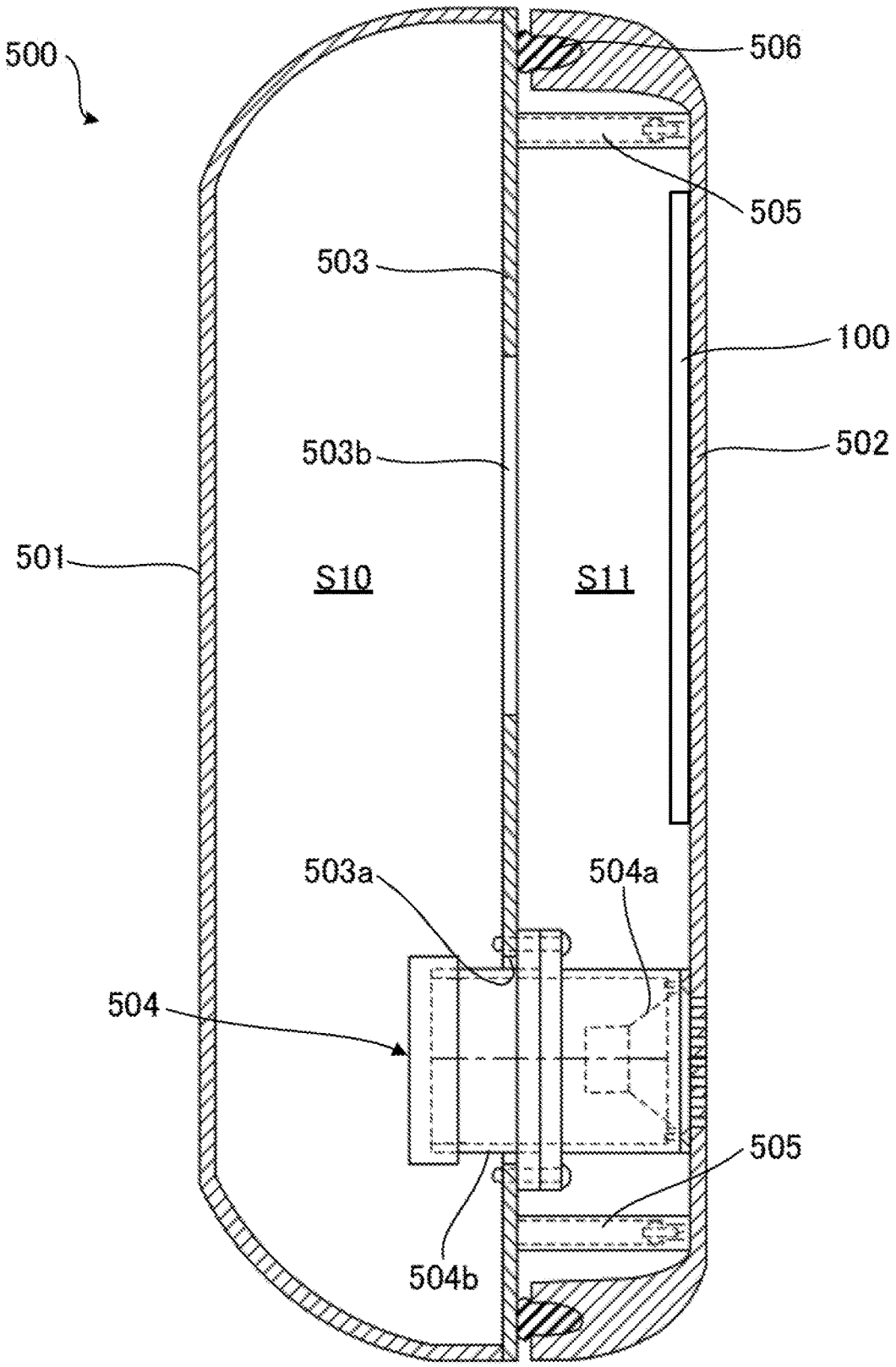
FIG. 12 is a cross-sectional view schematically showing an application example in a case in which the sound absorption structure is installed on a vehicle door.

FIG. 12 is a cross-sectional view schematically showing an application example in a case in which the sound absorption structure 100 is installed on a vehicle door 500. The door 500 shown in FIG. 12 includes a first panel 501 referred to as "outer panel", a second panel 502 referred to as "door trim", a third panel 503 referred to as "inner panel", a speaker unit 504 attached to the third panel 503, and the sound absorption structure 100 attached to the second panel 502.

The first panel 501 and the third panel 503 each is generally formed of steel plates. The first panel 501 and the third panel 503 are bonded to each other by welding, or the like. A space S10 is formed between the first panel 501 and the third panel 503. There are arranged a part of the speaker unit 504, a window glass (not shown), a window-glass lifting/lowering mechanism, a door lock mechanism, and the like in the space S10. The first panel 501 or the third panel 503 may be formed of, for example, an aluminum alloy or a carbon material.

The third panel 503 is provided with opening portions 503*a* and 503*b*. The opening portion 503*a* is an attachment hole for attaching the speaker unit 504 to the third panel 503. The opening portion 503*b* is, for example, a hole used for work in the space S10 described above. The opening portion 503*b* may be closed by the sound absorption structure 100 or may be closed by a simple resin sheet.

The second panel 502 is formed of, for example, resin. The second panel 502 is fixed to the third panel 503 with coupling mechanisms 505. The coupling mechanisms 505 may be freely selected as long as they can fix the second panel 502 to the third panel 503.

A space S11 exists between the second panel 502 and the third panel 503. A part of the speaker unit 504 not arranged in the space S10 is arranged in the space S11. A packing 506 formed of rubber or the like is arranged between the second panel 502 and the third panel 503 along an outer periphery of the second panel 502.

The sound absorption structure 100 is installed on an inner surface of the second panel 502. The frequency band in which the sound absorption structure 100 can absorb sound is set, for example, according to frequencies of standing waves in the space S10 or S11 described above. This setting improves the sound quality of the speaker unit 504. Penetration of road noise and the like from outside to inside a vehicle is also reduced by appropriately setting the frequency band in which the sound absorption structure 100 can absorb sound. The wall body 200 of the sound absorption structure 100 may be integral with the second panel 502 or may be a separate body therefrom. When the wall body 200 is a separate body from the second panel 502, the wall body 200 is fixed to the second panel 502 with, for example, an adhesive or a pressure-sensitive adhesive.

The speaker unit 504 includes, for example, a speaker body 504*a*, and a tubular housing 504*b* that houses the speaker body 504*a*. The speaker body 504*a* is fixed to the housing 504*b* by screwing or the like. The housing 504*b* is fixed to the third panel 503 by screwing or the like in a state of penetrating through the opening portion 503*a* of the third panel 503.

It is of note that, although a case in which the sound absorption structure 100 is installed on the door 500 is shown in FIG. 12, the sound absorption structure 100A or 100B, described later, may be used instead of the sound absorption structure 100. Further, although the door 500 is shown in FIG. 12, the sound absorption structure 100 may be installed on a part of the vehicle other than a door, such as a roof panel or a floor panel. The sound absorption structure 100 may be alternatively installed on movable bodies other than a vehicle.

3. Modifications

The present disclosure is not limited to the embodiment including the application example described above, and various modifications described below can be made. The embodiment and the respective modifications can be combined with one another as appropriate.

3-1. First Modification

Although a case in which Helmholtz resonators are constituted using the sound absorbing members 10 is exemplified in the embodiment described above, the configuration of the Helmholtz resonators is not limited to that in the embodiment described above.

Figure 13:
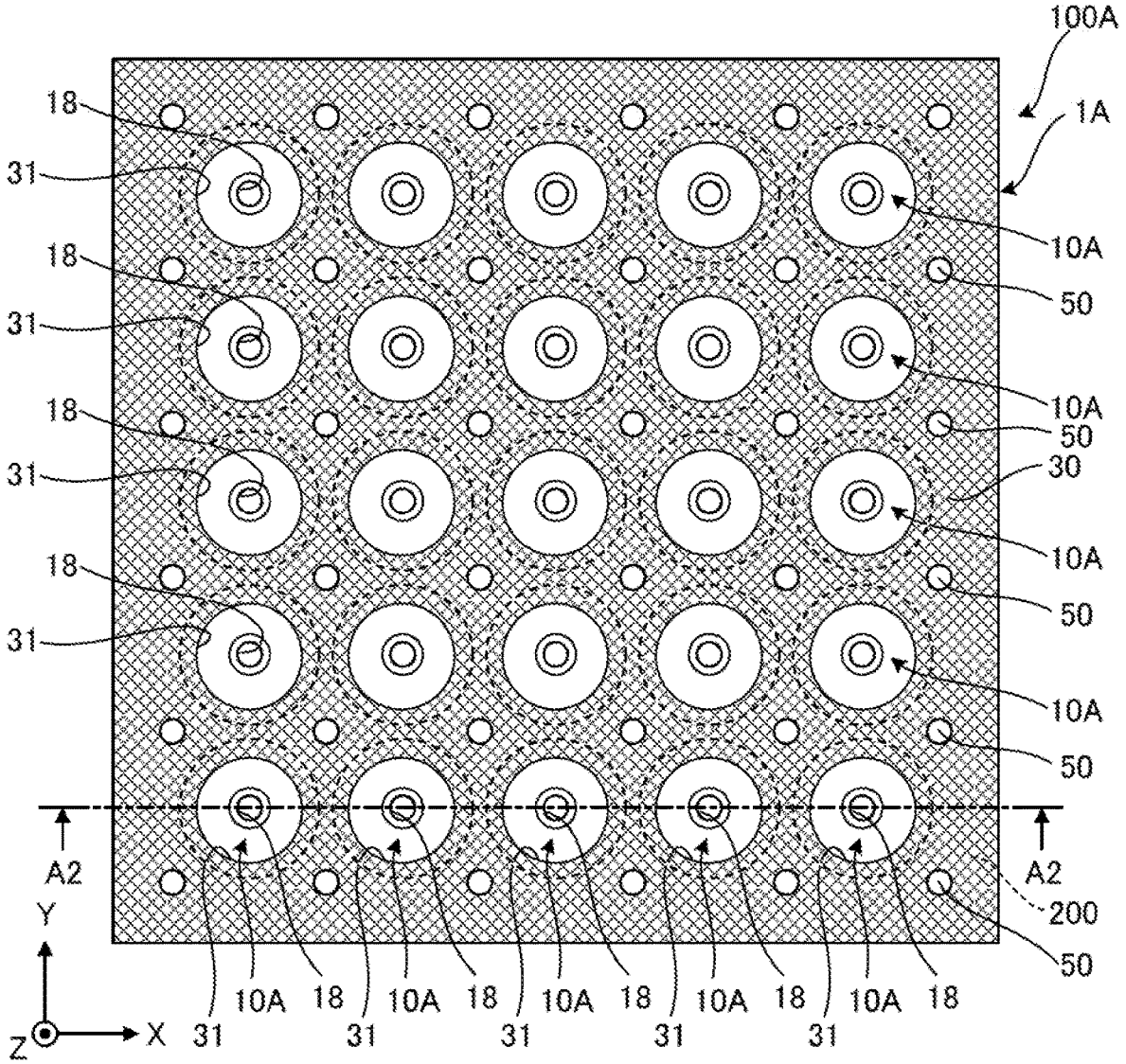
FIG. 13 is a plan view of a sound absorption structure according to a first modification.
Figure 14:
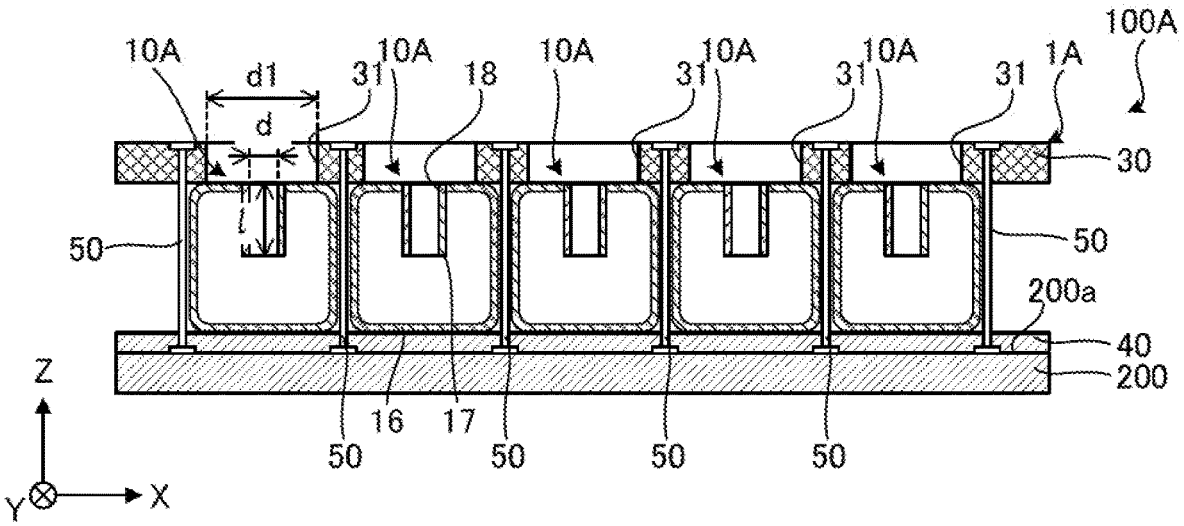
FIG. 14 is a cross-sectional view taken along a line A2-A2 in FIG. 13.

FIG. 13 is a plan view of a sound absorption structure 100A according to a first modification. FIG. 14 is a cross-sectional view taken along a line A2-A2 in FIG. 13. The sound absorption structure 100A shown in FIGS. 13 and 14 includes a sound absorbing apparatus 1A and the wall body 200. The sound absorbing apparatus 1A includes containers 10A, and the porous material 30, a support member 40, and coupling members 50 that hold the containers 10A.

Each of the containers 10A is an example of a first member constituting a Helmholtz resonator. Specifically, the containers 10A each include a container body 16 and a tube 17 penetrating from outside to inside the container body 16. An opening portion 18 of the tube 17 is an example of a first opening portion. In this manner, the containers 10A are hollow containers. Each of the containers 10A communicates with the outside through the respective opening portions 18. The constituent material of the containers 10A is not particularly limited, and is, for example, a resin material, a carbon material, a metallic material, a ceramics material, or a composite material including two or more thereof. Among these materials, a resin material is preferable because of having higher moldability, being lighter in the weight, and requiring lower cost than other materials. The containers 10A may be pliable. In this case, the frequency band in which the containers 10A can absorb sound is widened by changing the capacity of the containers 10A due to acoustic pressure. Since the containers 10A are Helmholtz resonators and constitute separate bodies from each other, the capacities do not change at any orientation. This allows a desired sound absorption effect even in a case in which the wall surface 200*a* of the wall body 200 is curved.

The support member 40 is an example of a third member arranged on the opposite side of the containers 10A to the porous material 30. The support member 40 is a member having a plate shape or a sheet shape. The support member 40 is preferably pliable similarly to the base material 20 and is formed of, for example, an elastomer material, a resin material, or a metallic material. The coupling members 50 are an example of fourth members. Specifically, the fourth members couple the porous material 30 and the support member 40 and hold the containers 10A between the porous material 30 and the support member 40. Each of the coupling members 50 shown in FIGS. 13 and 14 has an elongated shape extending through the porous material 30 and the support member 40. The width of both ends of each of the coupling members 50 is greater than the width of the remaining part. This configuration prevents the coupling members 50 from detaching from the porous material 30 and the support member 40. As described above, the containers 10A are held on the porous material 30 by the support member 40 and the coupling members 50. Accordingly, the sound absorbing apparatus 1A before installation on the wall body 200 is easily handled.

3-2. Second Modification

Figure 15:
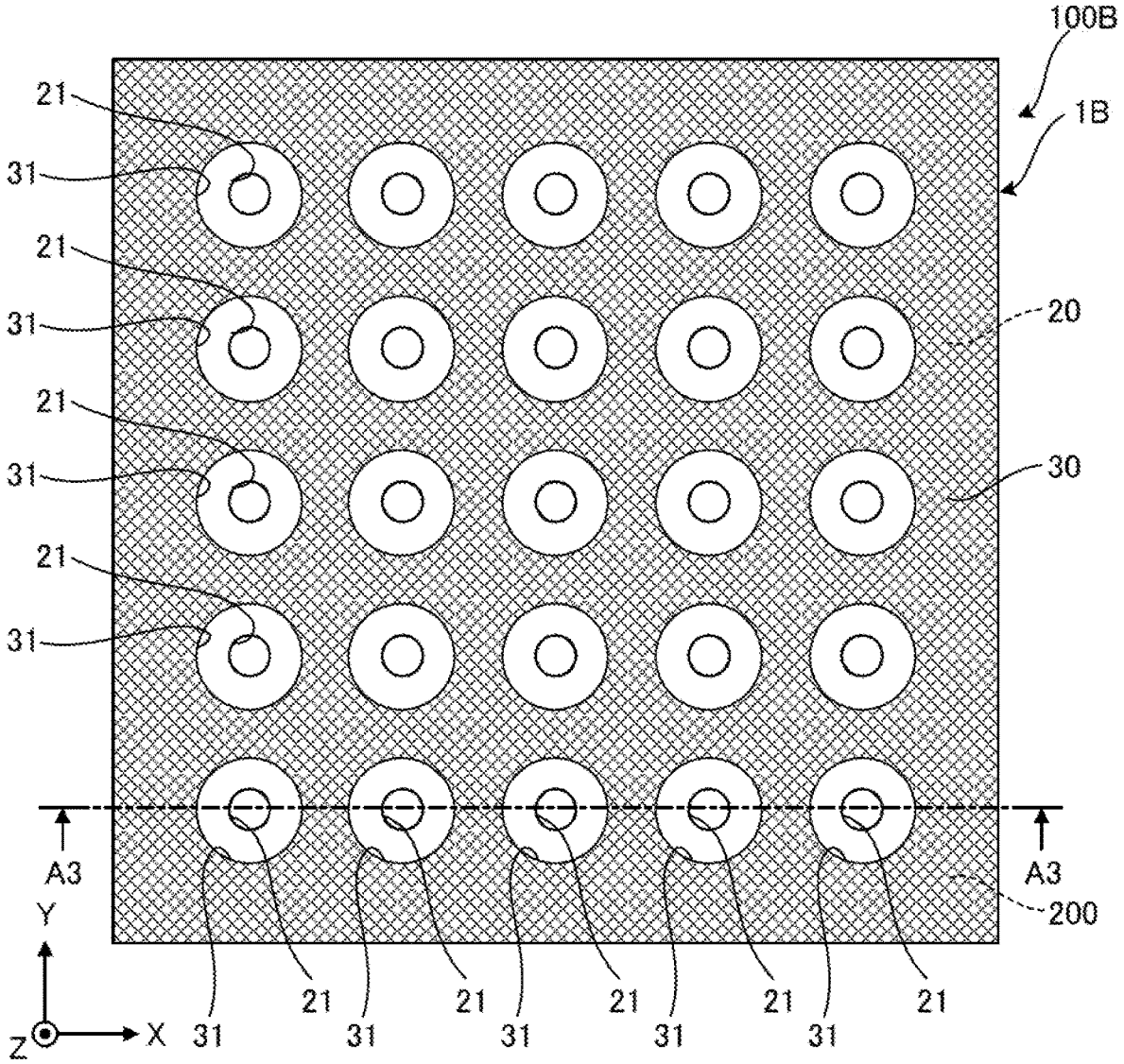
FIG. 15 is a plan view of a sound absorption structure according to a second modification.
Figure 16:
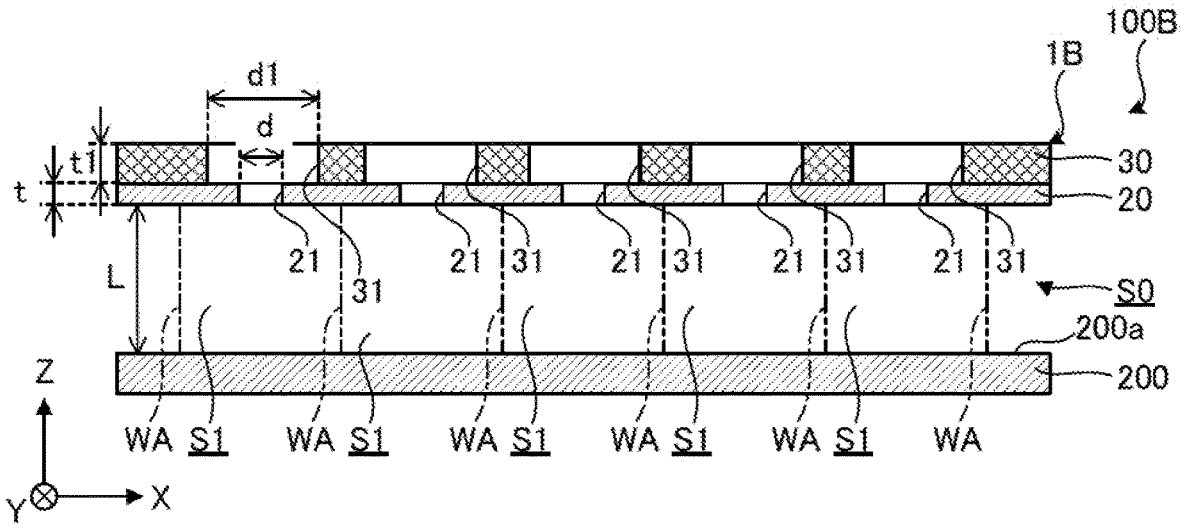
FIG. 16 is a cross-sectional view taken along a line A3-A3 in FIG. 15.

FIG. 15 is a plan view of the sound absorption structure 100B according to a second modification. FIG. 16 is a cross-sectional view taken along a line A3-A3 in FIG. 15. The sound absorption structure 100B shown in FIGS. 15 and 16 is identical to the sound absorption structure 100 according to the embodiment described above, except that the sound absorbing members 10 are omitted. That is, the sound absorption structure 100B includes a sound absorbing apparatus 1B and the wall body 200. The sound absorbing apparatus 1B is identical to the sound absorbing apparatus 1 in the embodiment described above except that the sound absorbing members 10 are omitted. The base material 20 is an example of a first member having a plate shape or a sheet shape. The holes 21 on the base material 20 are an example of a first opening portion. According to the sound absorbing apparatus 1B described above, the configuration of the sound absorbing apparatus 1B is simpler than a configuration in which a structure is provided for each of containers of Helmholtz resonators as in the first modification described above.

It is of note that the sound absorbing members 10 described above may be inserted into some of the holes 21 of the second modification, or a tubular member may be inserted into each of the holes 21 for adjustment of an opening width.

4. Appendix

The following aspects are understood as examples of the present disclosure based on the embodiment and modifications exemplified above.

A sound absorbing apparatus according to a preferred aspect (a first aspect) of the present disclosure includes a first member including at least one first opening portion for enabling Helmholtz resonance, and a second member that is disposed on the first member, has a plate shape or a sheet shape and is formed of a porous material, in which the second member includes at least one second opening portion overlapping one-to-one with the at least one first opening portion in planar view, and in which a periphery of each of the at least one second opening portion coincides with or is located outside a periphery of each corresponding one of the at least one first opening portion in planar view.

According to this aspect, a sound absorption effect due to both Helmholtz resonance and the porous material is obtained. This enables the sound-absorbable frequency band to be widened. Since the periphery of each second opening portion on the porous material is located outside a periphery of each corresponding first opening portion for enabling Helmholtz resonance in planar view, it is possible to suppress the porous material from hindering sound absorption due to Helmholtz resonance.

In a preferred aspect (a second aspect) according to the first aspect, when the at least one first opening portion has a width d and the at least one second opening portion has a width d1, d1/d is not less than 1.0 and is not greater than 6.0.

According to this aspect, it is possible to achieve both the sound absorption effect due to Helmholtz resonance and the sound absorption effect due to the porous material.

In a preferred aspect (a third aspect) according to the first or second aspect, an aperture ratio of the at least one second opening portion on the second member is equal to or less than 50%.

According to this aspect, there can be provided an identical degree of sound absorption effect due to the porous material as that in a case of including no second holes.

In a preferred aspect (a fourth aspect) according to any one of the first to third aspects, the first member includes a planar or a sheet-like base material, and a tubular sound absorbing member penetrating through the base material and having the at least one first opening portion thereon.

According to this aspect, it is possible to lower the sound-absorbable frequency band of a sound absorption structure while the sound absorption structure is made thinner.

In a preferred aspect (a fifth aspect) according to any one of the first to third aspects, the first member is a hollow container communicated with outside via the at least one first opening portion.

According to this aspect, a desired sound absorption effect is obtained even in a case in which a wall surface of a wall body is curved.

In a preferred aspect (a sixth aspect) according to the fifth aspect, the sound absorbing apparatus includes a third member on an opposite side of the first member to the second member, and a plurality of fourth members that couple the second member and the third member and hold the first member between the second member and the third member.

According to this aspect, the first member is held on the second member by the third member and the fourth member, and thus, the sound absorbing apparatus is easily handled before installation on the wall body.

In a preferred aspect (a seventh aspect) according to any one of the first to third aspects, the first member has a plate shape or a sheet shape.

According to this aspect, the sound absorbing apparatus has a simpler configuration than a configuration in which a structure is provided for each of containers of Helmholtz resonators.

A sound absorption structure according to a preferred aspect (an eighth aspect) of the present disclosure includes the sound absorbing apparatus according to any one of the first to seventh aspects, and a wall body on which the sound absorbing apparatus is installed.

According to this aspect, it is possible to obtain a sound absorption structure having a wider sound-absorbable frequency band than a sound absorption structure using only either a Helmholtz resonator or a porous material.

DESCRIPTION OF REFERENCE SIGNS

1 . . . sound absorbing apparatus, 1A . . . sound absorbing apparatus, 1B . . . sound absorbing apparatus, 10 . . . sound absorbing member, 10A . . . container, 12 . . . opening portion, 18 . . . opening portion, 20 . . . base material, 21 . . . hole, 30 . . . porous material, 31 . . . hole, 40 . . .

support member, 50 . . . coupling member, 100 . . . sound absorption structure, 100A . . . sound absorption structure, 100B . . . sound absorption structure, 200 . . . wall body, 200*a* . . . wall surface, E1 . . . first end face.

What is claimed is:

1. A sound absorbing apparatus comprising:

a first member including at least one first opening portion for enabling Helmholtz resonance; and a second member that is disposed on the first member, has a plate shape or a sheet shape, and is formed of a porous material, wherein the second member includes at least one second opening portion overlapping one-to-one with the at least one first opening portion in planar view, wherein a periphery of each of the at least one second opening portion is located outside a periphery of each corresponding one of the at least one first opening portion in planar view, and wherein the at least one first opening portion has a width d, the at least one second opening portion has a width d1, and d1/d is greater than 1.0 and is not greater than 6.0.

2. The sound absorbing apparatus according to claim 1, wherein an aperture ratio of an area of the at least one second opening portion relative to an area of the second member is equal to or less than 50%.

3. The sound absorbing apparatus according to claim 1, wherein the first member includes:

a planar or a sheet-like base material; and a tubular sound absorbing member penetrating through the base material and having the at least one first opening portion thereon.

4. The sound absorbing apparatus according to claim 1, wherein the first member is a hollow container communicating with outside of the hollow container via the at least one first opening portion.

5. The sound absorbing apparatus according to claim 4, further comprising:

a third member on an opposite side of the first member to the second member; and a plurality of fourth members that couple the second member and the third member and hold the first member between the second member and the third member.

6. The sound absorbing apparatus according to claim 1, wherein the first member has a plate shape or a sheet shape.

7. A sound absorption structure comprising:

a sound absorbing apparatus; and a wall body on which the sound absorbing apparatus is installed, wherein the sound absorbing apparatus comprises:

a first member including at least one first opening portion for enabling Helmholtz resonance; and a second member that is disposed on the first member, has a plate shape or a sheet shape, and is formed of a porous material, wherein the second member includes at least one second opening portion overlapping one-to-one with the at least one first opening portion in planar view, wherein a periphery of each of the at least one second opening portion is located outside a periphery of each corresponding one of the at least one first opening portion in planar view, and wherein the at least one first opening portion has a width d, the at least one second opening portion has a width d1, and d1/d is greater than 1.0 and is not greater than 6.0.

* * * * *